US007540037B1

(12) United States Patent
Bittler et al.

(10) Patent No.: US 7,540,037 B1
(45) Date of Patent: Jun. 2, 2009

(54) VENTILATED WEATHERPROOF GARMENT

(76) Inventors: Robert Bittler, 73 Paragon Dr., Bunker Hill, WV (US) 25413; Edison Langley, 706 Loop Rd., Gerrardstown, WV (US) 25420-3576

( * ) Notice: Subject to any disclaimer, the term of this patent is extended or adjusted under 35 U.S.C. 154(b) by 477 days.

(21) Appl. No.: 11/361,657

(22) Filed: Feb. 23, 2006

(51) Int. Cl.
*A41D 13/00* (2006.01)

(52) U.S. Cl. ..... 2/69

(58) Field of Classification Search ..... 2/108, 2/69, 94, 115, 79, 227, 255, 262, 264, 232, 2/243.1, DIG. 1
See application file for complete search history.

(56) References Cited

U.S. PATENT DOCUMENTS

| | | | | | |
|---|---|---|---|---|---|
| 1,679,102 | A | * | 7/1928 | Thompson | 2/228 |
| 3,045,243 | A | * | 7/1962 | Seymour et al. | 2/1 |
| 3,153,793 | A | * | 10/1964 | Lepore | 2/93 |
| 4,722,099 | A | | 2/1988 | Kratz | |
| 5,088,116 | A | | 2/1992 | Gould | |
| 5,105,477 | A | * | 4/1992 | Golde | 2/93 |
| 5,642,526 | A | | 7/1997 | Thompson | |
| 5,704,064 | A | * | 1/1998 | van der Sleesen | 2/69 |
| 6,158,056 | A | | 12/2000 | Riley | |
| 6,237,152 | B1 | | 5/2001 | Gootrad | |
| 6,339,845 | B1 | * | 1/2002 | Burns et al. | 2/243.1 |
| 2002/0095712 | A1 | | 7/2002 | Fayle et al. | |
| 2003/0033656 | A1 | | 2/2003 | Jaeger | |

* cited by examiner

*Primary Examiner*—Tejash Patel

(57) ABSTRACT

A protective garment includes a water impermeable jacket that has a pair of coextensive interior edges that are coupled to each other. One edge includes a flap extending along a length thereof that covers the edges while same are coupled together. A collar is pressed against a driver's neck and has a hood conjoined thereto. A water impermeable trouser has an elastic waist band. Elastic leg bands are fitted about lower extremities thereof. Elastic straps have opposed ends coupled to the lower extremities and the leg bands and has an apex spaced below the leg band. Draw strings are intercalated between interior and exterior jacket surfaces. A mechanism is included for storing articles within the jacket and the trouser while allowing air to flow through the jacket and the trouser for ventilating the driver. The storing mechanism is adaptable between open and closed positions.

15 Claims, 6 Drawing Sheets

VENTILATED WEATHERPROOF GARMENT

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to garments and, more particularly, to a ventilated weatherproof garment for shielding a motorcycle driver from inclement weather conditions while allowing air to simultaneously pass through said garment.

2. Prior Art

In many sport and adventuresome events, such as motorcycle riding, it is prudent to wear an abrasive resistant outer garment for protection in case of spills. When being ridden, a motorcycle provides very little protection to the cyclist while being very susceptible to actions which separate the cyclist from the motorcycle at high speed, either through collision with an object or other vehicle, a momentary loss of balance or an abrupt change in speed or direction of travel due to sudden changes in the terrain. When a cyclist is thrown or jumps free from a motorcycle during times of emergency, the severity of injuries sustained can be reduced substantially if the cyclist's body is not subject to tearing injuries due to the glancing impacts with the fuel tank and handle bars of the motorcycle, burn injuries caused by vaporized fuel generated by the impact and skin injuries caused by abrasive sliding contact between the cyclist and the ground.

As sport cyclists have become more safety minded, they, like racers, have desired protective jackets and pants constructed from leather or leather-like materials. This is because leather garments are soft enough to be comfortable and to allow unrestrictive movement while protecting the wearer against cold and wet weather, and high speed spills. Unfortunately, for many, motorcycling is a summer activity in weather conditions of high heat and humidity. Leather garments, being relatively non-porous, act to retain the metabolic heat of a body. The heat retention makes "leathers" extremely uncomfortable, and causes the wearer to discard them on hot days, thereby increasing the risk of serious injury.

Various attempts have been made at protective garments in the prior art to rectify the problem of providing adequate protection to a motorcyclist while also allowing for enough cooling to encourage the wear of the protective garment. One prior art garment includes mesh vents at locations which require little protection, such as adjacent to the underarms extending from chest to back, inside the elbows, and at the neck. Scoops which open in response to a predetermined air flow velocity and constrict in response to higher velocities are also provided. Unfortunately, the mesh vents in this example have no means for being permanently closed in the event of inclement weather conditions where ventilation is not necessary. The above-noted example also lacks any sufficient storage pouches on the exterior of the garment where a motorcyclist can conveniently store and easily retrieve vital traveling documents like maps and a driver's license etc.

Accordingly, a need remains for a ventilated weatherproof garment in order to overcome the above-noted shortcomings. The present invention satisfies such a need by providing protective and ventilated weatherproof garment that is comfortable to wear, convenient to use, and is versatile in the applications thereof. Instead of being forced to repeatedly stop along the highway to remove or apply a rain suit, the garment quickly adapts to different weather conditions. During periods of rain the garment protects the rider and prevent them from becoming drenched, which is rather uncomfortable. Once the rain ceases and the sun emerges again, the zippers of the garment are quickly and easily opened for a ventilating and cooling effect. This advantageously allows for comfortable and uninterrupted travel while riding in intermittent inclement weather conditions.

BRIEF SUMMARY OF THE INVENTION

In view of the foregoing background, it is therefore an object of the present invention to provide a ventilated weatherproof garment. These and other objects, features, and advantages of the invention are provided by a protective garment for shielding a motorcycle driver from inclement weather conditions while allowing air to simultaneously pass through said garment.

The protective garment includes a jacket that has an exterior surface formed from water impermeable material. The jacket further has a pair of coextensively shaped and rectilinear interior edges that are removably coupled to each other. One of the interior edges includes an elongated flap extending along an entire longitudinal length of the one interior edge such that the flap completely covers the interior edges while the interior edges are coupled to each other and thereby advantageously prevents rain and debris from passing through the interior edges. Such a jacket has an annular collar directly pressed against a neck of the driver in such a manner that rain and debris are effectively and conveniently prohibited from seeping underneath the collar. The jacket further includes a hood that is removably conjoined directly to the collar. Such a jacket preferably further includes a plurality of elastic straps that are directly coupled to outer ends of sleeves of the jacket such that fluid and debris are advantageously prohibited from passing upwardly along arms of the driver during operating conditions. The elastic straps are seated about wrists of the driver.

A trouser has an exterior surface formed from water impermeable material. Such a trouser has an elastic waist band. The trouser further has elastic leg bands directly fitted about lower extremities of the trouser such that the elastic leg bands tightly wrap about ankles of the driver during riding conditions. Such a trouser also has a pair of elastic straps that have opposed end portions directly coupled to the lower extremities and the leg bands respectively. Each of the elastic straps has an apex centrally spaced below the leg band respectively such that the elastic straps tightly fit about both feet of the driver for preventing the lower extremities of the trouser from sliding up and away from the driver ankles during high speed riding conditions.

The trouser may include a plurality of coextensively shaped heat resistant pads that are directly attached to the exterior surface thereof. Such heat resistant pads have a bottom end contiguously abutted against the lower extremities of the trouser. The heat resistant pads travel up along the trouser wherein the heat resistant pads terminate at a knee region of the driver. Such heat resistant pads are situated along a medial face of the lower extremities and travel partially thereabout.

The trouser preferably further includes at least one zipper extending along a rectilinear path traveling upwardly along one leg of the trouser. Such an at least one zipper has opposed end portions directly connected to one of the lower extremities and is situated subjacent to the elastic waist band respectively so that the driver can conveniently quickly removed the trouser during non-driving conditions.

A plurality of unitary and flexible draw strings are intercalated between an interior surface and the exterior surface of the jacket. Each of the draw strings has a first end seated outside of the jacket and above a bottom edge thereof such that the first ends can be tied together for compressing a lower section of the jacket and thereby advantageously and effectively prohibiting rain and water from seeping upwardly through the jacket during high speed driving conditions.

A mechanism is included for simultaneously storing articles within the jacket and the trouser while allowing air to flow through the jacket and the trouser for conveniently and effectively ventilating the driver during operating conditions without requiring the driver to detach the interior edges of the jacket or loosen the collar. Such a storing mechanism is adaptable between open and closed positions wherein air is allowed to flow through the jacket and the trouser and the articles are removable from the jacket and the trouser when the storage mechanism is adapted to the open position. The articles are effectively protected from rain and debris, and air is prohibited from passing through the jacket and the trouser when the storage mechanism is adapted to the closed position. Such a storage mechanism is selectively adaptable between the open and closed positions such that selected areas of the jacket and the trouser can be ventilated while other areas of the jacket and the trouser remain isolated from rain and debris.

The storage mechanism preferably includes a plurality of chambers that have fasteners directly attached thereto. Each of the chambers has a mesh rear lining situated to an interior of the outer surfaces of the jacket and the trouser respectively such that the articles are conveniently and effectively prohibited from passing through the mesh rear lining while air is allowed to flow through the mesh rear lining and travel through an interior of the jacket and the trouser respectively. A rear ventilation zone is formed along an interior side of the jacket and is made from mesh material such that air can exit through the rear ventilation zone and escape downwardly through a bottom edge of the jacket. The chambers allow air to flow through the jacket and the trouser when the chambers are adapted to the open position. Such chambers effectively prevent rain and debris from flowing through the jacket and the trouser when the chambers are adapted to the closed position. Selected ones of the chambers may be located adjacent to arm pits of the jacket for conveniently allowing the driver to easily store and access the articles therein under driving conditions.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
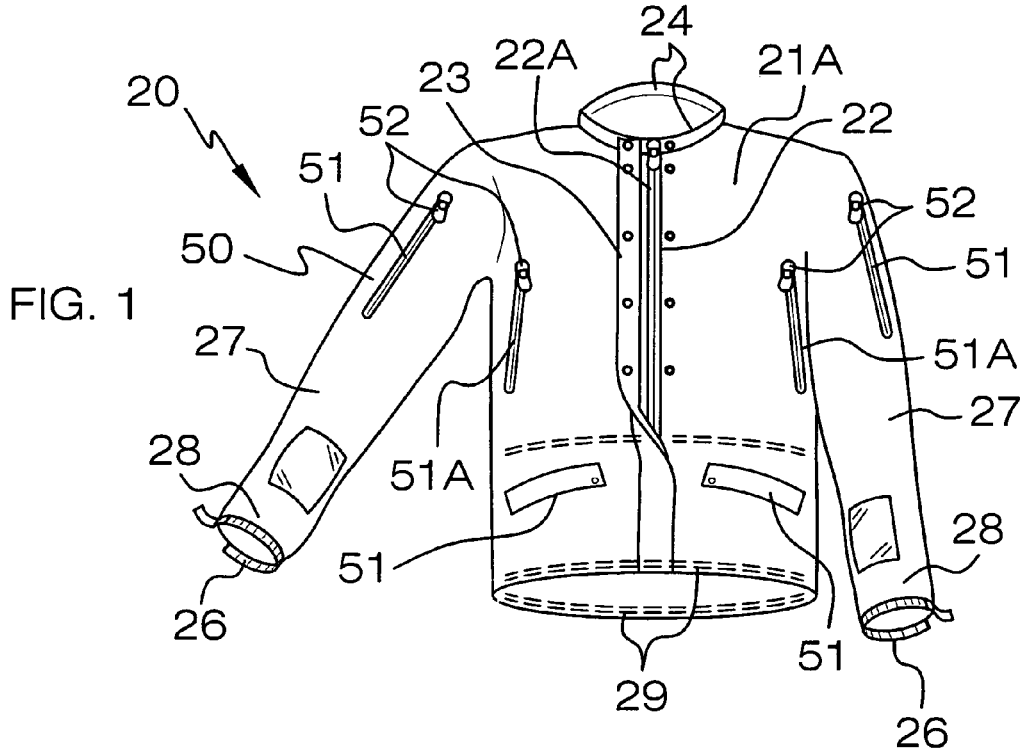
FIG. 1 is a front-elevational view showing a protective and ventilated weatherproof jacket, in accordance with the present invention.
Figure 2:
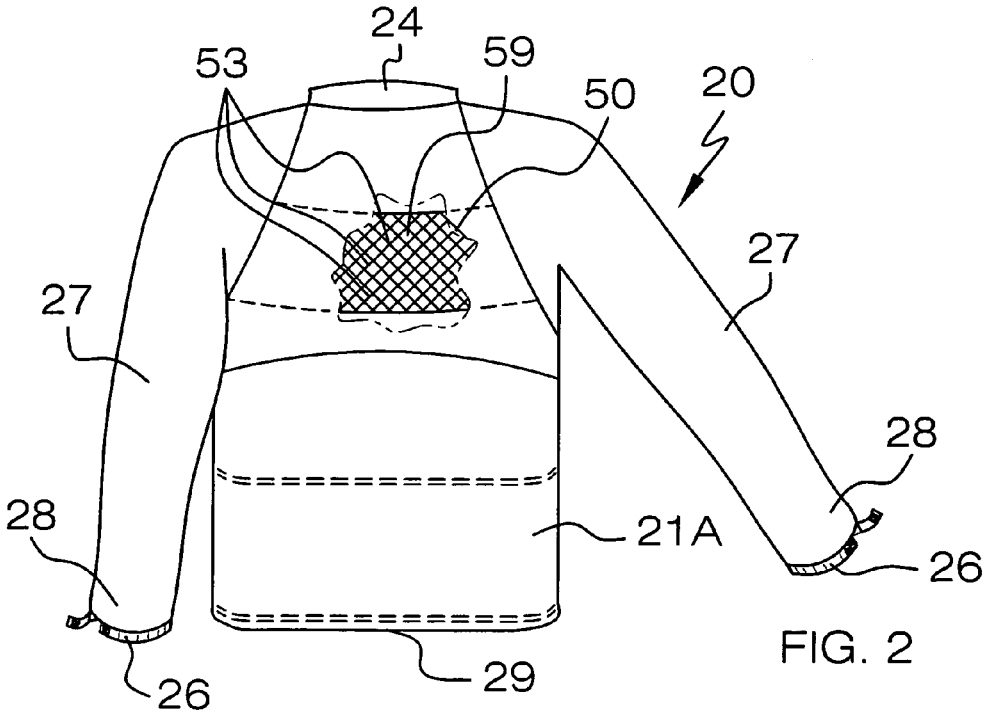
FIG. 2 is a rear-elevational view of the jacket shown in FIG. 1.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The garment of this invention is referred to generally in FIGS. 1-7 by the reference numeral 10 and is intended to provide a ventilated and weatherproof garment. It should be understood that the garment 10 may be used to provide protection during many different types of activities and should not be limited in use to only motorcycle driving conditions.

Referring initially to FIGS. 1, 2, 3 and 7, the garment 10 includes a jacket 20 that has an exterior surface 21A formed from water impermeable material like leather, which is a crucial feature for allowing the jacket 20 to prevent rain and debris from passing therethrough. Of course, the jacket 20 may be produced in a variety of alternate sizes and colors so as to fit persons of all sizes and to appeal to various fashion tastes, respectively, as is obvious to a person of ordinary skill in the art. Such a jacket 20 further has a pair of coextensively shaped and rectilinear interior edges 22 that are removably coupled to each other. One of the interior edges 22A includes an elongated flap 23 extending along an entire longitudinal length of the one interior edge 22A, which is essential such that the flap 23 completely covers the interior edges 22 while the interior edges 22 are coupled to each other and thereby advantageously prevents rain and debris from passing through the interior edges 22. Such a jacket 20 has an annular collar 24 directly pressed, without the use of intervening elements, against a neck of the driver 11 in such a manner that rain and debris are effectively and conveniently prohibited from seeping underneath the collar 24. The jacket further includes a hood 25 that is removably conjoined directly, without the use of intervening elements, to the collar 24. Such a hood 25 conveniently prevents a user's hair from becoming wet while wearing the jacket 20 during non-driving conditions. The jacket 20 further includes a plurality of elastic straps 26 that are directly coupled, without the use of intervening elements, to outer ends 28 of sleeves 27 of the jacket 20, which is critical such that fluid and debris are advantageously prohibited from passing upwardly along arms of the driver 11 during operating conditions. The elastic straps 26 are seated about wrists of the driver 11. Of course, the driver 11 may also wear water impermeable gloves (not shown) that extend over the sleeves 27 of the jacket 20 for effectively protecting the user's hand from inclement weather conditions and for preventing rain from entering the sleeves 27.

Referring to FIGS. 4, 5, 6 and 7, a trouser 30 has an exterior surface 31 formed from water impermeable material like leather which is a crucial feature for allowing the trouser 30 to prevent rain and debris from passing therethrough. Of course, the trouser 30 may be produced in a variety of alternate sizes and colors so as to fit persons of all sizes and to appeal to various fashion tastes, respectively, as is obvious to a person of ordinary skill in the art. Such a trouser 30 has an elastic waist band 32A. The trouser 30 further has elastic leg bands 32B directly fitted, without the use of intervening elements, about lower extremities 33 of the trouser 30 such that the elastic leg bands 32B tightly wrap about ankles of the driver 11 during riding conditions. Such a trouser 30 also has a pair of elastic straps 32C that have opposed end portions 34 directly coupled, without the use of intervening elements, to the lower extremities 33 and the leg bands 32B respectively. Each of the elastic straps 32C has an apex 35 centrally spaced below the leg band 32B respectively such that the elastic straps 32C tightly fit about both feet 13 of the driver 11, which is vital for preventing the lower extremities 33 of the trouser 30 from sliding up and away from the driver ankles during high speed riding conditions.

Figure 4:
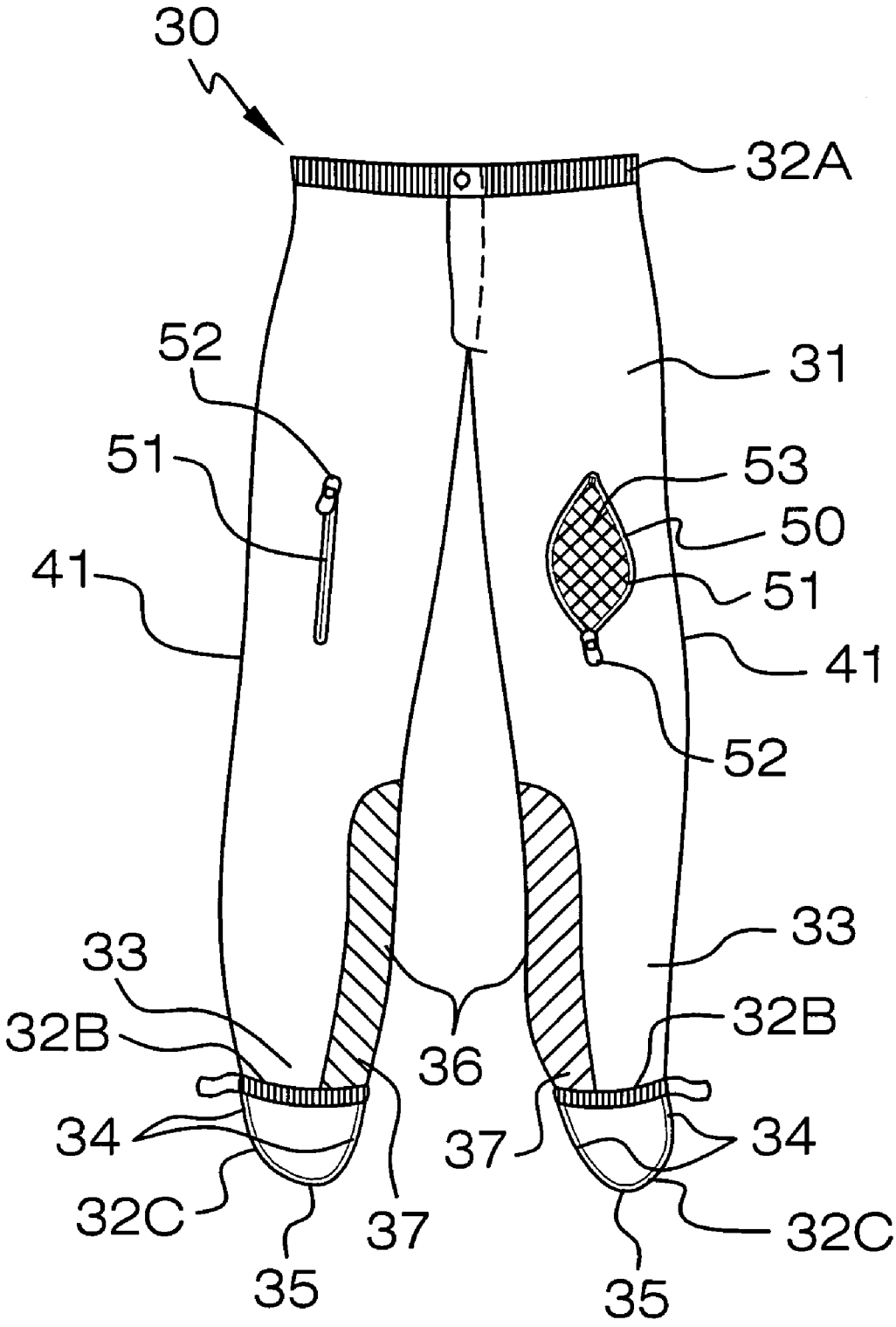
FIG. 4 is a front-elevational view showing a protective and ventilated weatherproof trouser, in accordance with the present invention.
Figure 5:
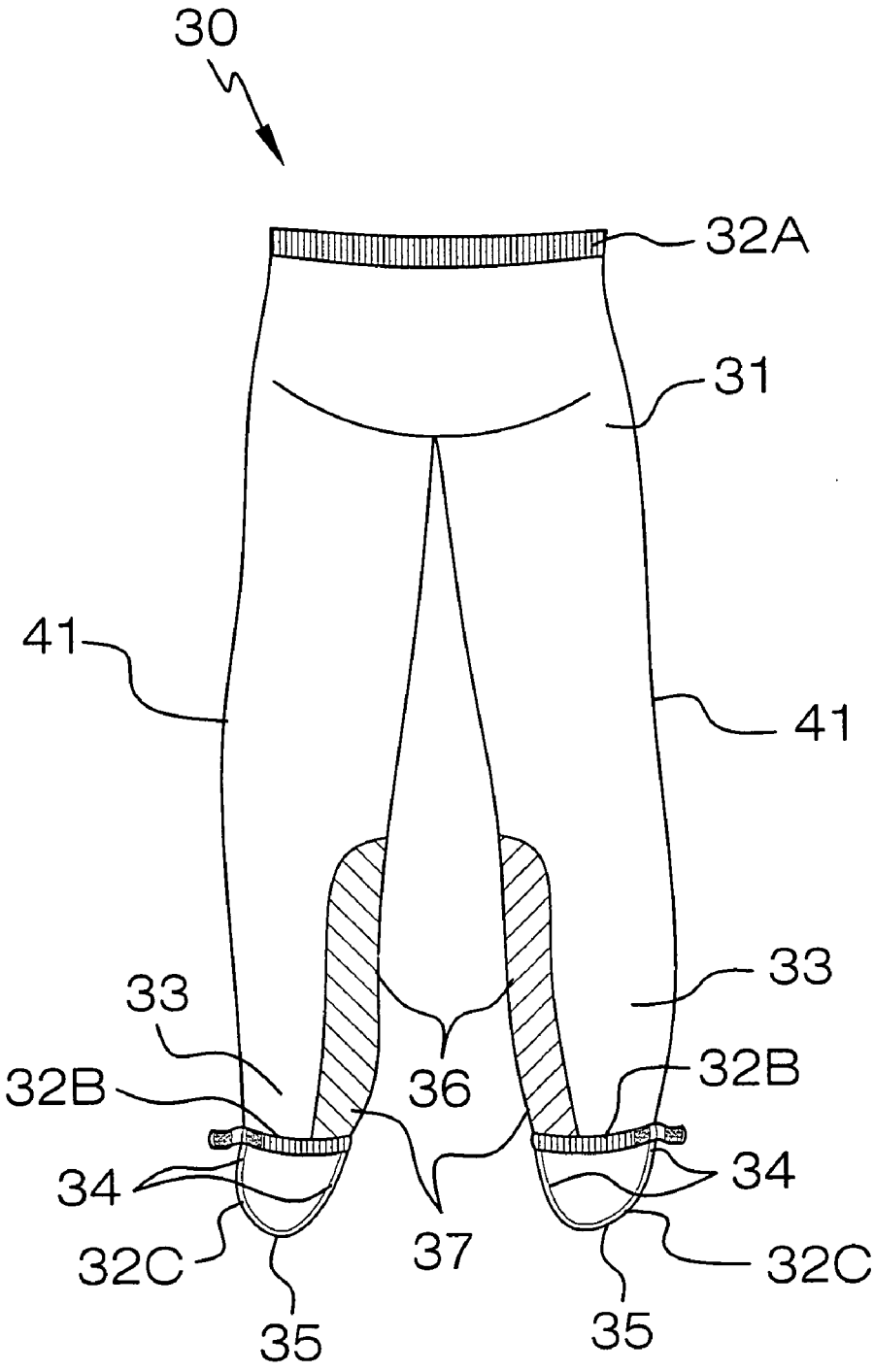
FIG. 5 is a rear-elevational view of the trouser shown in FIG. 4.
Figure 6:
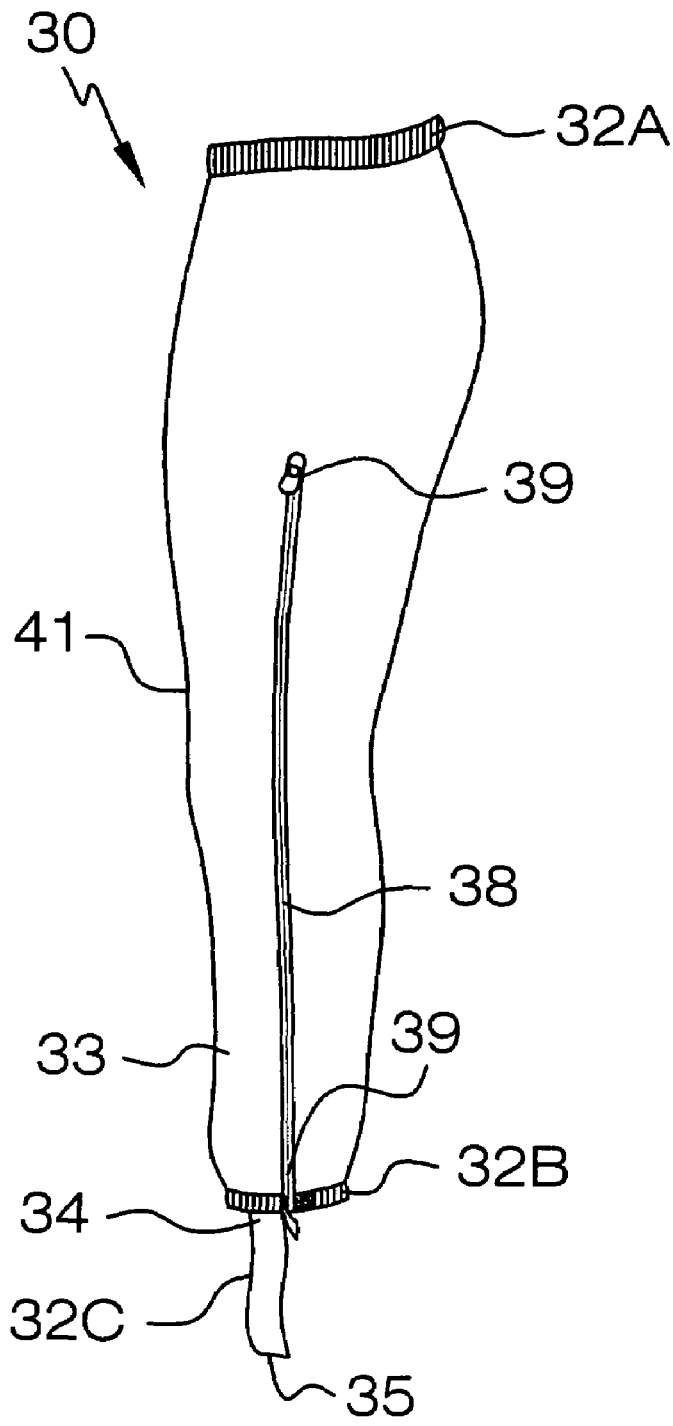
FIG. 6 is a side-elevational view of the trouser shown in FIG. 4.
Figure 7:
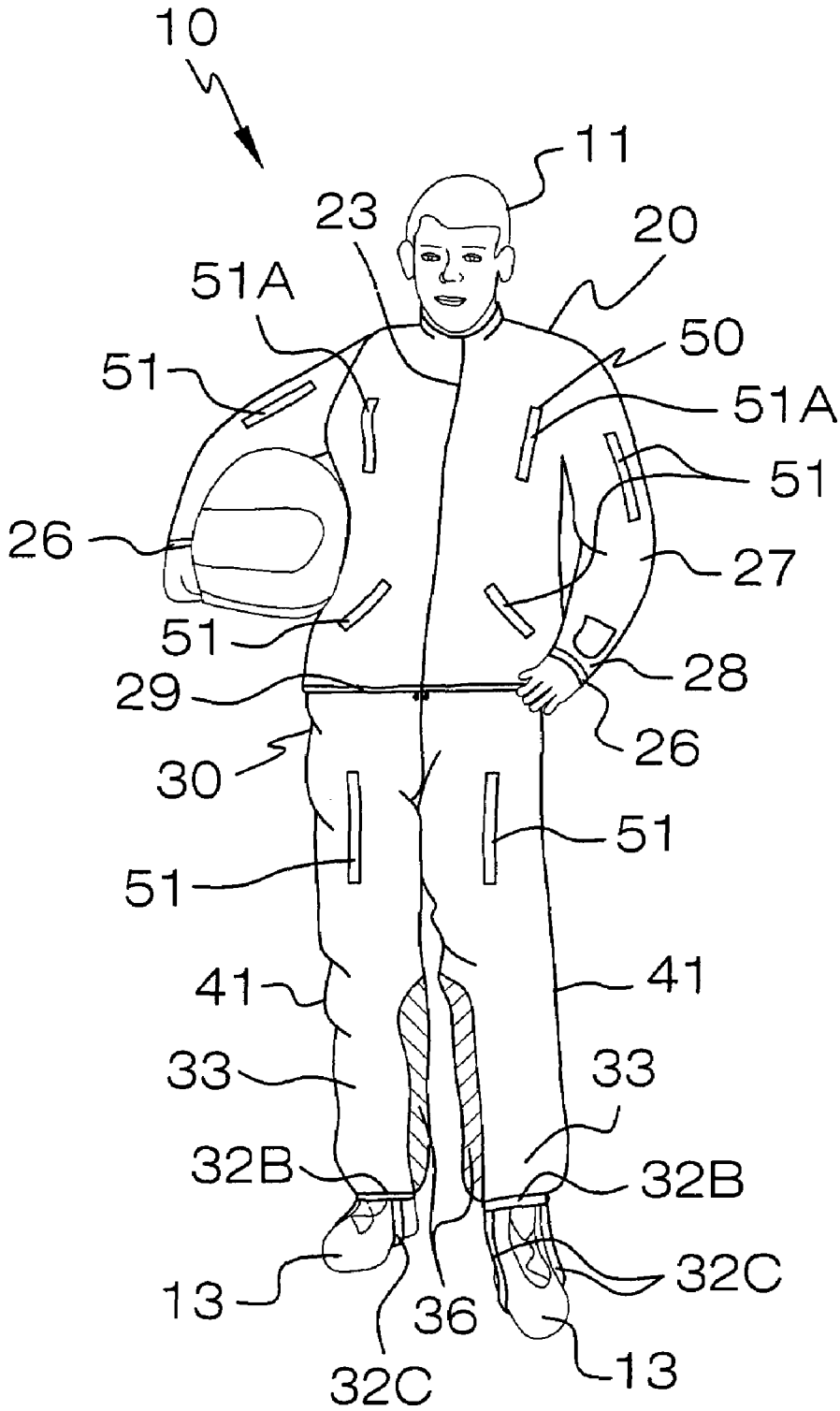
FIG. 7 is a perspective view showing a motorcyclist wearing the protective and ventilated weatherproof jacket and trouser, in accordance with the present invention.

Referring to FIGS. 4, 5 and 7, the trouser 30 includes a plurality of coextensively shaped heat resistant pads 36 that are directly attached, without the use of intervening elements, to the exterior surface 31 thereof. Such heat resistant pads 36 have a bottom end 37 contiguously abutted against the lower extremities 33 of the trouser 30 and are essential for protecting a driver's legs from the motorcycle's warm exhaust system components that are usually in close proximity to the driver's legs during driving conditions. The heat resistant pads 36 travel up along the trouser 30 wherein the heat resistant pads 36 terminate at a knee region of the driver 11. Such heat resistant pads 36 are situated along a medial face of the lower extremities 33 and travel partially thereabout. The trouser 30 further includes at least one zipper 38 extending along a rectilinear path traveling upwardly along one leg 41 of the trouser 30. Such an at least one zipper 38 has opposed end portions 39 directly connected, without the use of intervening elements, to one of the lower extremities 33 and is situated subjacent to the elastic waist band 32A respectively, which is critical so that the driver 11 can conveniently quickly removed the trouser 30 during non-driving conditions.

Figure 3:
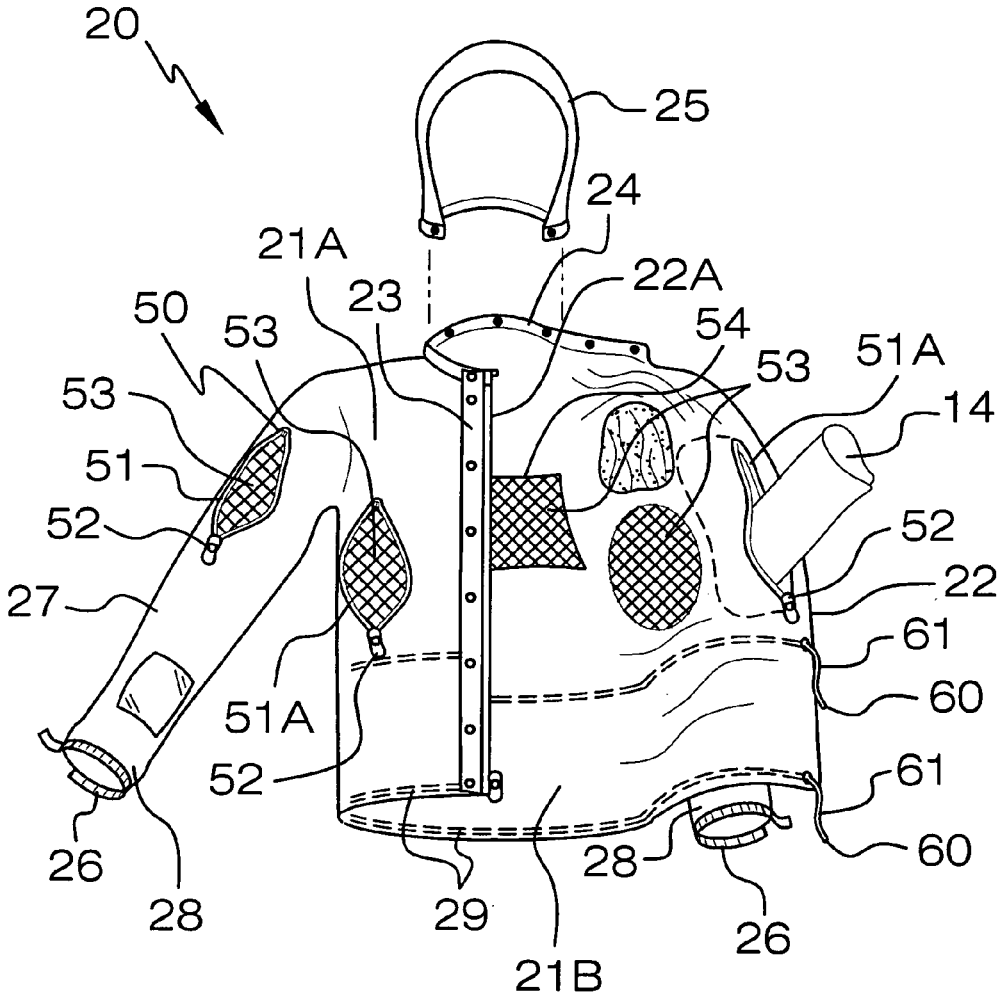
FIG. 3 is a front-elevational view of the jacket shown in FIG. 1, showing the jacket adapted to an open position.

Referring to FIG. 3, a plurality of unitary and flexible draw strings 60 are intercalated between an interior surface 21B and the exterior 21A surface of the jacket 20. Each of the draw strings 60 has a first end 61 seated outside of the jacket 20 and above a bottom edge 29 thereof, which is important such that the first ends 61 can be tied together for compressing a lower section of the jacket 20 and thereby advantageously and effectively prohibiting rain and water from seeping upwardly through the jacket 20 during high speed driving conditions.

Referring to FIGS. 1, 3, 4 and 7, a mechanism 50 is included for simultaneously storing articles 14 within the jacket 20 and the trouser 30 while allowing air to flow through the jacket 20 and the trouser 30, which is a vital feature for conveniently and effectively ventilating the driver 11 during operating conditions without requiring the driver 11 to detach the interior edges 22 of the jacket 20 or loosen the collar 24. Such a storing mechanism 50 is adaptable between open and closed positions wherein air is allowed to flow through the jacket 20 and the trouser 30 and the articles 14 are removable from the jacket 20 and the trouser 30 when the storage mechanism 50 is adapted to the open position. The articles 14 are effectively protected from rain and debris, and air is prohibited from passing through the jacket 20 and the trouser 30 when the storage mechanism 50 is adapted to the closed position. Such a storage mechanism 50 is selectively adaptable between the open and closed positions such that selected areas of the jacket 20 and the trouser 30 can effectively be ventilated while other areas of the jacket 20 and the trouser 30 remain isolated from rain and debris.

Referring to FIGS. 1, 2, 3, 4 and 7, the storage mechanism 50 includes a plurality of chambers 51 that have fasteners 52 directly attached thereto, without the use of intervening elements. Each of the chambers 51 has a mesh rear lining 53 situated to an interior of the outer surfaces 21, 31 of the jacket 20 and the trouser 30 respectively such that the articles 14 are conveniently and effectively prohibited from passing through the mesh rear lining 53 while air is allowed to flow through the mesh rear lining 53 and travel through an interior of the jacket 20 and the trouser 30 respectively. A rear ventilation zone 54 is formed along an interior side 21B of the jacket 20 and is made from mesh material such that air can exit through the rear ventilation zone 54 and escape downwardly through a bottom edge 29 of the jacket 20.

The chambers 51 effectively allow air to flow through the jacket 20 and the trouser 30 when the chambers 51 are adapted to the open position. Such chambers 51 effectively prevent rain and debris from flowing through the jacket 20 and the trouser 30 when the chambers 51 are adapted to the closed position, thus advantageously ensuring that the driver 11 remains dry while driving in inclement weather conditions. Selected ones 51A of the chambers 51 are located adjacent to arm pits of the jacket 20, which is important for conveniently allowing the driver 11 to easily store and access the articles 14 therein under driving conditions.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A protective garment for shielding a motorcycle driver from inclement weather conditions while allowing air to simultaneously pass through said garment, said protective garment comprising:

a jacket having an exterior surface formed from water impermeable material, said jacket further having a pair of coextensively shaped and rectilinear interior edges removably coupled to each other, one of said interior edges including an elongated flap extending along an entire longitudinal length of said one interior edge such that said flap completely covers said interior edges while said interior edges are coupled to each other and thereby preventing rain and debris from passing through said interior edges, said jacket having an annular collar directly pressed against a neck of the driver in such a manner that rain and debris are prohibited from seeping underneath said collar;

a trouser having an exterior surface formed from water impermeable material, said trouser further having an elastic waist band, said trouser further having elastic leg bands directly fitted about lower extremities of said trouser such that said elastic leg bands tightly wrap about ankles of the driver during riding conditions, said trouser further having a pair of elastic straps having opposed end portions directly coupled to said lower extremities and said leg bands respectively, each of said elastic straps having an apex centrally spaced below said leg band respectively such that said elastic straps tightly fit about both feet of the driver for preventing said lower extremities of said trouser from sliding up and away from the driver ankles during high speed riding conditions; and means for simultaneously storing articles within said jacket and said trouser while allowing air to flow through said jacket and said trouser for ventilating the driver during operating conditions without requiring the driver to detach said interior edges of said jacket or loosen said collar, said storing means being adaptable between open and closed positions wherein air is allowed to flow through said jacket and said trouser and the articles are removable from said jacket and said trouser when said storage means is adapted to the open position, said articles being protected from rain and debris and air being prohibited from passing through said jacket and said trouser when said storage means is adapted to the closed position;

wherein said trouser comprises a plurality of coextensively shaped heat resistant pads directly attached to said exterior surface thereof, said heat resistant pads having a bottom end contiguously abutted against said lower extremities of said trouser, said heat resistant pads traveling up along said trouser wherein said heat resistant pads terminate at a knee region of the driver, said heat resistant pads being situated along a medial face of said lower extremities and traveling partially thereabout.

2. The garment of claim 1, wherein said storage means comprises:

a plurality of chambers having fasteners directly attached thereto, each of said chambers having a mesh rear lining situated interior of said outer surfaces of said jacket and said trouser respectively such that the articles are prohibited from passing through said mesh rear lining while air is allowed to flow through said mesh rear lining and travel through an interior of said jacket and said trouser respectively;

a rear ventilation zone formed along an interior side of said jacket and being made from mesh material such that air can exit through said rear ventilation zone and escape downwardly through a bottom edge of said jacket; and wherein said chambers allow air to flow through said jacket and said trouser when said chambers are adapted to the open position, said chambers preventing rain and debris from flowing through said jacket and said trouser when said chambers are adapted to the closed position.

3. The garment of claim 1, wherein said jacket further comprises:

a plurality of elastic straps directly coupled to outer ends of sleeves of said jacket such that fluid and debris are prohibited from passing upwardly along arms of the driver during operating conditions, said elastic straps being seated about wrists of the driver.

4. The garment of claim 1, wherein said trouser further comprises:

at least one zipper extending along a rectilinear path traveling upwardly along one leg of said trouser, said at least one zipper having opposed end portions directly connected to one of said lower extremities and situated subjacent said elastic waist band respectively so that the driver can quickly removed said trouser during non-driving conditions.

5. The garment of claim 2, wherein selected ones of said chambers are located adjacent to arm pits of said jacket for allowing the driver to easily store and access the articles therein under driving conditions.

6. A protective garment for shielding a motorcycle driver from inclement weather conditions while allowing air to simultaneously pass through said garment, said protective garment comprising:

a jacket having an exterior surface formed from water impermeable material, said jacket further having a pair of coextensively shaped and rectilinear interior edges removably coupled to each other, one of said interior edges including an elongated flap extending along an entire longitudinal length of said one interior edge such that said flap completely covers said interior edges while said interior edges are coupled to each other and thereby preventing rain and debris from passing through said interior edges, said jacket having an annular collar directly pressed against a neck of the driver in such a manner that rain and debris are prohibited from seeping underneath said collar;

a trouser having an exterior surface formed from water impermeable material, said trouser further having an elastic waist band, said trouser further having elastic leg bands directly fitted about lower extremities of said trouser such that said elastic leg bands tightly wrap about ankles of the driver during riding conditions, said trouser further having a pair of elastic straps having opposed end portions directly coupled to said lower extremities and said leg bands respectively, each of said elastic straps having an apex centrally spaced below said leg band respectively such that said elastic straps tightly fit about both feet of the driver for preventing said lower extremities of said trouser from sliding up and away from the driver ankles during high speed riding conditions; and means for simultaneously storing articles within said jacket and said trouser while allowing air to flow through said jacket and said trouser for ventilating the driver during operating conditions without requiring the driver to detach said interior edges of said jacket or loosen said collar, said storing means being adaptable between open and closed positions wherein air is allowed to flow through said jacket and said trouser and the articles are removable from said jacket and said trouser when said storage means is adapted to the open position, said articles being protected from rain and debris and air being prohibited from passing through said jacket and said trouser when said storage means is adapted to the closed position;

wherein said storage means is selectively adaptable between the open and closed positions such that selected areas of said jacket and said trouser can be ventilated while other areas of said jacket and said trouser remain isolated from rain and debris, said jacket further including a hood removably conjoined directly to said collar;

wherein said trouser comprises a plurality of coextensively shaped heat resistant pads directly attached to said exterior surface thereof, said heat resistant pads having a bottom end contiguously abutted against said lower extremities of said trouser, said heat resistant pads traveling up along said trouser wherein said heat resistant pads terminate at a knee region of the driver, said heat resistant pads being situated along a medial face of said lower extremities and traveling partially thereabout.

7. The garment of claim 6, wherein said storage means comprises:

a plurality of chambers having fasteners directly attached thereto, each of said chambers having a mesh rear lining situated interior of said outer surfaces of said jacket and said trouser respectively such that the articles are prohibited from passing through said mesh rear lining while air is allowed to flow through said mesh rear lining and travel through an interior of said jacket and said trouser respectively;

a rear ventilation zone formed along an interior side of said jacket and being made from mesh material such that air can exit through said rear ventilation zone and escape downwardly through a bottom edge of said jacket; and wherein said chambers allow air to flow through said jacket and said trouser when said chambers are adapted to the open position, said chambers preventing rain and debris from flowing through said jacket and said trouser when said chambers are adapted to the closed position.

8. The garment of claim 6, wherein said jacket further comprises:

a plurality of elastic straps directly coupled to outer ends of sleeves of said jacket such that fluid and debris are prohibited from passing upwardly along arms of the driver during operating conditions, said elastic straps being seated about wrists of the driver.

9. The garment of claim 6, wherein said trouser further comprises:

at least one zipper extending along a rectilinear path traveling upwardly along one leg of said trouser, said at least one zipper having opposed end portions directly connected to one of said lower extremities and situated subjacent said elastic waist band respectively so that the driver can quickly removed said trouser during non-driving conditions.

10. The garment of claim 7, wherein selected ones of said chambers are located adjacent to arm pits of said jacket for allowing the driver to easily store and access the articles therein under driving conditions.

11. A protective garment for shielding a motorcycle driver from inclement weather conditions while allowing air to simultaneously pass through said garment, said protective garment comprising:

a jacket having an exterior surface formed from water impermeable material, said jacket further having a pair of coextensively shaped and rectilinear interior edges removably coupled to each other, one of said interior edges including an elongated flap extending along an entire longitudinal length of said one interior edge such that said flap completely covers said interior edges while said interior edges are coupled to each other and thereby preventing rain and debris from passing through said interior edges, said jacket having an annular collar directly pressed against a neck of the driver in such a manner that rain and debris are prohibited from seeping underneath said collar;

a trouser having an exterior surface formed from water impermeable material, said trouser further having an elastic waist band, said trouser further having elastic leg bands directly fitted about lower extremities of said trouser such that said elastic leg bands tightly wrap about ankles of the driver during riding conditions, said trouser further having a pair of elastic straps having opposed end portions directly coupled to said lower extremities and said leg bands respectively, each of said elastic straps having an apex centrally spaced below said leg band respectively such that said elastic straps tightly fit about both feet of the driver for preventing said lower extremities of said trouser from sliding up and away from the driver ankles during high speed riding conditions;

a plurality of unitary and flexible draw strings intercalated between an interior surface and said exterior surface of said jacket, each of said draw strings having a first end seated outside of said jacket and above a bottom edge thereof such that said first ends can be tied together for compressing a lower section of said jacket and thereby prohibiting rain and water from seeping upwardly through said jacket during high speed driving conditions; and means for simultaneously storing articles within said jacket and said trouser while allowing air to flow through said jacket and said trouser for ventilating the driver during operating conditions without requiring the driver to detach said interior edges of said jacket or loosen said collar, said storing means being adaptable between open and closed positions wherein air is allowed to flow through said jacket and said trouser and the articles are removable from said jacket and said trouser when said storage means is adapted to the open position, said articles being protected from rain and debris and air being prohibited from passing through said jacket and said trouser when said storage means is adapted to the closed position;

wherein said storage means is selectively adaptable between the open and closed positions such that selected areas of said jacket and said trouser can be ventilated while other areas of said jacket and said trouser remain isolated from rain and debris, said jacket further including a hood removably conjoined directly to said collar;

wherein said trouser comprises a plurality of coextensively shaped heat resistant pads directly attached to said exterior surface thereof, said heat resistant pads having a bottom end contiguously abutted against said lower extremities of said trouser, said heat resistant pads traveling up along said trouser wherein said heat resistant pads terminate at a knee region of the driver, said heat resistant pads being situated along a medial face of said lower extremities and traveling partially thereabout.

12. The garment of claim 11, wherein said storage means comprises:

a plurality of chambers having fasteners directly attached thereto, each of said chambers having a mesh rear lining situated interior of said outer surfaces of said jacket and said trouser respectively such that the articles are prohibited from passing through said mesh rear lining while air is allowed to flow through said mesh rear lining and travel through an interior of said jacket and said trouser respectively;

a rear ventilation zone formed along an interior side of said jacket and being made from mesh material such that air can exit through said rear ventilation zone and escape downwardly through a bottom edge of said jacket; and wherein said chambers allow air to flow through said jacket and said trouser when said chambers are adapted to the open position, said chambers preventing rain and debris from flowing through said jacket and said trouser when said chambers are adapted to the closed position.

13. The garment of claim 11, wherein said jacket further comprises:

a plurality of elastic straps directly coupled to outer ends of sleeves of said jacket such that fluid and debris are prohibited from passing upwardly along arms of the driver during operating conditions, said elastic straps being seated about wrists of the driver.

14. The garment of claim 11, wherein said trouser further comprises:

at least one zipper extending along a rectilinear path traveling upwardly along one leg of said trouser, said at least one zipper having opposed end portions directly connected to one of said lower extremities and situated subjacent said elastic waist band respectively so that the driver can quickly removed said trouser during non-driving conditions.

15. The garment of claim 12, wherein selected ones of said chambers are located adjacent to arm pits of said jacket for allowing the driver to easily store and access the articles therein under driving conditions.

* * * * *